United States Patent [19]

Sakata et al.

[11] Patent Number: 4,558,997

[45] Date of Patent: Dec. 17, 1985

[54] SCROLL COMPRESSOR WITH PLANAR SURFACES ON THE INTERNAL END PORTIONS OF THE SCROLL BLADES

[75] Inventors: Hirotsugu Sakata, Chigasaki; Shigemi Nagatomo, Tokyo, both of Japan

[73] Assignee: Tokyo Shibaura Denki Kabushiki Kaisha, Kawasaki, Japan

[21] Appl. No.: 518,629

[22] Filed: Jul. 29, 1983

[30] Foreign Application Priority Data

Jul. 30, 1982 [JP] Japan ..... 57-133319

[51] Int. Cl.[4] ..... F04C 18/04

[52] U.S. Cl. ..... 418/55

[58] Field of Search ..... 418/55

[56] References Cited

U.S. PATENT DOCUMENTS 3,473,728 10/1969 Vulliez ..... 418/55
3,874,827 4/1975 Young ..... 418/55
4,141,677 2/1979 Weaver et al. ..... 418/55

FOREIGN PATENT DOCUMENTS 814179 3/1937 France ..... 418/55

*Primary Examiner*—John J. Vrablik
*Attorney, Agent, or Firm*—Schwartz, Jeffery, Schwaab, Mack, Blumenthal & Evans

[57] ABSTRACT

A scroll compressor includes a casing, an electric motor and a compressor unit housed in the casing and the compressor unit comprises a movable member having a first scroll blade driven eccentrically by the electric motor and a structural member having a second scroll blade encasing the movable member so that the first scroll blade revolves around a central axis of the compressor with a predetermined radius of revolution, while the first blade is maintained in sliding contact with the second blade. The two scroll blades are formed by drawing a series of semicircles alternately around a first point and a second point spaced apart from the first point. An internal end portion of the first and second scroll blades includes a planar surface disposed perpendicular to a line interconnecting the first and second point.

7 Claims, 21 Drawing Figures

SCROLL COMPRESSOR WITH PLANAR SURFACES ON THE INTERNAL END PORTIONS OF THE SCROLL BLADES

BACKGROUND OF THE INVENTION

This invention relates to scroll compressors, and more particularly to a type thereof wherein the volume of a residual portion of the compressive space formed between a stationary scroll blade and an orbitally movable scroll blade at the final stage of the compressive operation of the compressor is substantially reduced compared to that of an ordinary scroll compressor, thereby improving the efficiency and the compression ratio.

Ordinarily, a scroll compressor comprises a stationary scroll blade and an orbitally movable scroll blade, which are formed into equal configurations operable in sliding engagement with each other. A gaseous fluid supplied through a suction port into the compressor is confined in closed spaces formed between the scroll blades in accordance with the progress of the rotation of the orbitally movable blade. The fluid is then delivered through an exhaust port, provided in a central portion of the stationary scroll blade, which is brought into communication with the compressive spaces at the final stage.

The stationary and orbitally movable scroll blades of conventional configurations, which are identical to each other, may be formed as shown in FIG. 1. In the shown construction, first and second points A and B are provided in a spaced-apart relation by a distance equal to the sum of e and t, wherein e represents a radius of revolution and t represents the thickness of either one of the two blades. Upper semicircles $\widehat{AC}$ and $\widehat{DE}$ are first drawn around the second point B with radii equal to $R_2=t+e$ and $R_3=2t+e$, respectively. Likewise, lower semicircles $\widehat{CF}$ and $\widehat{EG}$ are drawn around the first point A with radii $R_4=2t+2e$ and $R_5=3t+2e$, respectively. The upper semicircles $\widehat{FH}$ and $\widehat{GI}$ are drawn around the point B with radii $R_6=3t+3e$ and $R_7=4t+3e$, respectively. The internal end of the scroll blade is closed by an arc drawn around the point A with a radius equal to $R_1=t$, the arc intersecting with an extension of the semicircle $\widehat{AC}$ at a point J. The outer end of the scroll member is closed by a semicircle $\widehat{HI}$ drawn around the line $\overline{HI}$.

Relative positions of the stationary scroll blade 1 and the orbitally movable scroll blade 2 during the compression operation of the compressor are shown in FIGS. 2(*a*), 2(*b*) and 2(*c*). In a state shown in FIG. 2(*a*), a gas is received between the two blades 1 and 2, while in a state shown in FIG. 2(*b*), the received gas is confined in compressive spaces 3 each having a volume $V_1$. In a state shown in FIG. 2(*c*) corresponding to the last stage of the compression, the volume of each compressive space 3 is reduced to $V_2$.

In the conventional scroll blades of the above described construction, however, a residual region 4 is formed as shown in FIG. 2(*c*) at the last stage of the compression, and the gas remaining in the residual region 4 flows back into the compressive spaces 3 when the state of the operation of the compressor returns to that shown in FIG. 2(*a*), thus deteriorating the efficiency and reducing the compression ratio of the compressor.

SUMMARY OF THE INVENTION

An object of the present invention is to provide a scroll compressor comprising a stationary scroll blade and an orbitally movable scroll blade, the configuration of the internal ends of which is improved such that the residual region formed at the last stage of the compression is reduced, and the compression ratio of the compressor is thereby improved.

The above-described and other objects of the present invention can be achieved by a scroll compressor which comprises a stationary scroll blade and an orbitally movable scroll blade which are contained in a casing and formed into substantially equal configurations having a thickness t, means for driving the orbitally movable scroll blade eccentrically so that the blade is moved, in contact with the stationary blade, in a revolution following an orbit of a radius e, the stationary and orbitally movable scroll blades being formed in such a manner that a series of semicircles are drawn around two central points spaced apart by (e+t), alternately, and the semicircles thus drawn are connected together into a scroll configuration; the improvement wherein a planar surface is formed in an internal end portion of each scroll blade so as to extend perpendicularly to a straight line interconnecting the two central points.

DESCRIPTION OF THE PREFERRED EMBODIMENTS

The invention will now be described in detail with reference to FIGS. 3 through 13.

Figure 1:
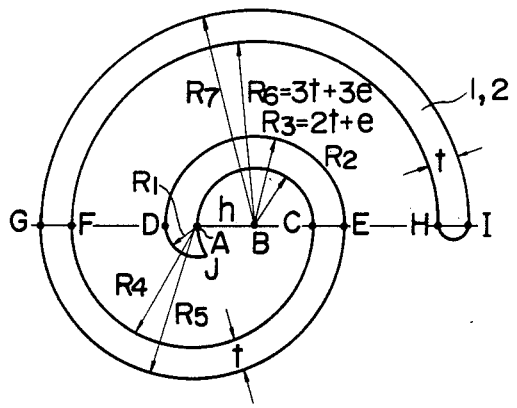
FIG. 1 PRIOR ART
FIG. 1 is a plan view showing the configuration of a scroll blade of a conventional scroll compressor.
Figure 2A:
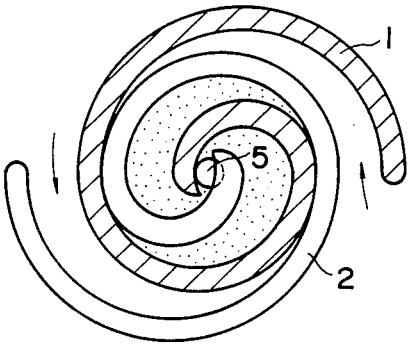
FIG. 2(a) PRIOR ART
FIGS. 2(*al ), 2*(*b*) and 2(*c*) are plan views showing various stages of the compressing operation of the conventional compressor.
Figure 2B:
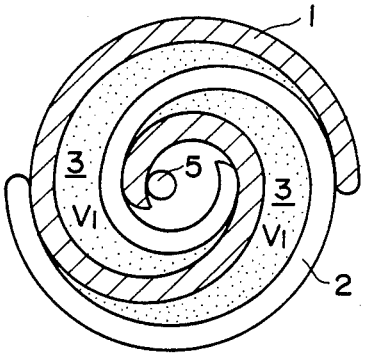
FIG. 2(b) PRIOR ART
Figure 2C:
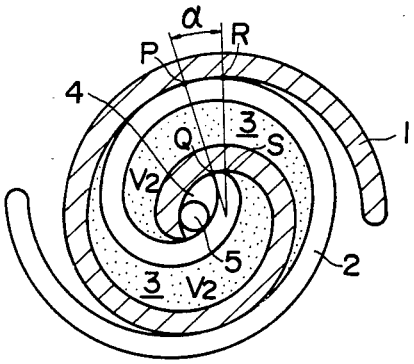
FIG. 2(c) PRIOR ART
Figure 3:
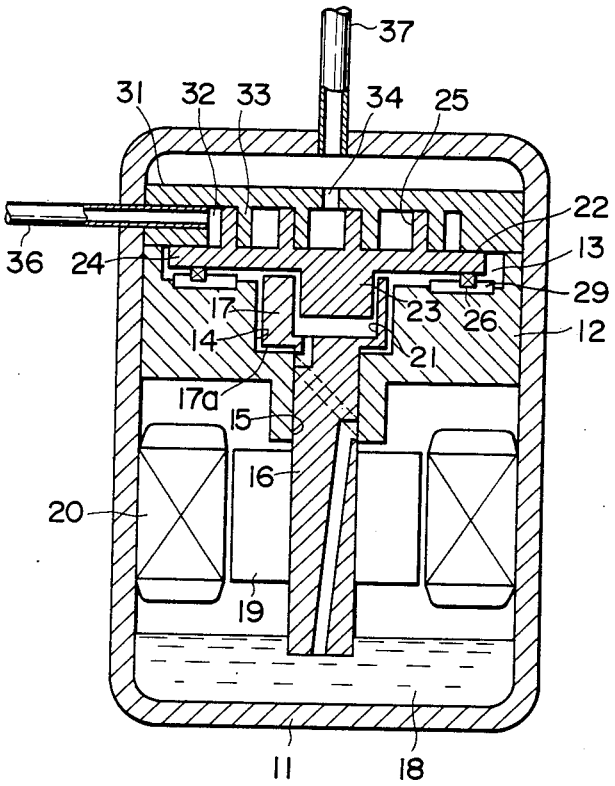
FIG. 3 is a vertical sectional view of a scroll compressor according to the present invention.

In a scroll compressor shown in FIG. 3, there is provided a casing 11 of a totally enclosed type, in which a frame member 12 of the compressor is encased in a force fit manner. In the frame member 12, there are formed a circular recess 13 for receiving a scroll member to be described hereinafter, a head-receiving recess 14 and a bearing hole 15 concentrically in a stepwise manner.

An electric motor having a rotor 19 and a stator 20 is also provided in the casing 11 so that the stator 20 is secured to the casing suitably. A driving shaft 16 extending upwardly from the rotor 19 through the bearing hole 15 of the frame member 12 is coupled with a shaft head 17 having a larger diameter than that of the shaft 16 and received in the head receiving recess 14 to rotate freely. The driving shaft 16 also extends downwardly from the rotor 19 so that the lower end of the shaft 16 is submerged into lubricating oil 18 stored in the bottom portion of the casing 11. The underside surface 17*a* of the shaft head 17 abuts against the bottom of the recess 14 formed in the mounting frame 12 so that the rotor 19 and the shaft 16 are rotatably supported by the frame member 12. A cylindrical hole 21 is formed in the shaft head 17 at a position eccentric with the shaft head.

Figure 4:
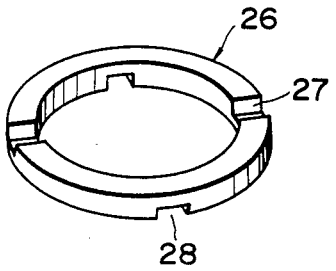
FIG. 4 is a perspective view showing an Oldham's ring used in FIG. 3.

An orbitally movable scroll member 22 having a disc-like portion 24 is received in the circular recess 13 formed in the frame member 12, and a downward projection 23 projecting from the center of the disc-like portion 24 is received rotatably in the hole 21. A scroll blade 25 is formed on the upper surface of the disc-like portion 24. The movable scroll member 22 is supported by an Oldham's ring 26 provided under side of the disc-like portion 24. The Oldham's ring 26 has a rectangular cross-section and is provided with radial key grooves 27 and 28 disposed perpendicular to each other on the upper side and lower side thereof, respectively, as shown in FIG. 4. Keys 29 extending diametrically along the bottom surface of the recess 13 are slidably received in the grooves 28, while keys (not shown) extending perpendicularly to the keys 29 along the underside surface of the disc-like portion 24 are slidably received in the grooves 27. As a consequence, when the downward projection 23 of the orbitally movable scroll member 22 is driven by the driving shaft 16 to revolve around the central axis of the driving shaft 16, the orbitally movable scroll blade 25 of the scroll member 22 is revolved by the aid of the Oldham's ring 26 without being rotated relative to the mounting frame 12.

Above the frame member 12, there is provided a shroud (or otherwise termed a stationary scroll member) 31. The shroud 31 is fixed to the mounting frame 12 with the movable scroll member 22 interposed therebetween. A stationary scroll blade 33 of an equal configulation with the orbitally movable scroll blade 25 is formed integrally on the surface of the shroud 31 facing the orbitally movable scroll member 22 at a position slidably engageable with the movable scroll blade 25.

A suction pipe 36 is introduced through the casing 11 into the suction chamber 32 formed circumferentially of the stationary scroll blade 33, while an outlet pipe 37 passed through the casing 11 into a space communicating with a delivery port 34 formed through a central part of the shroud 31.

Figure 5:
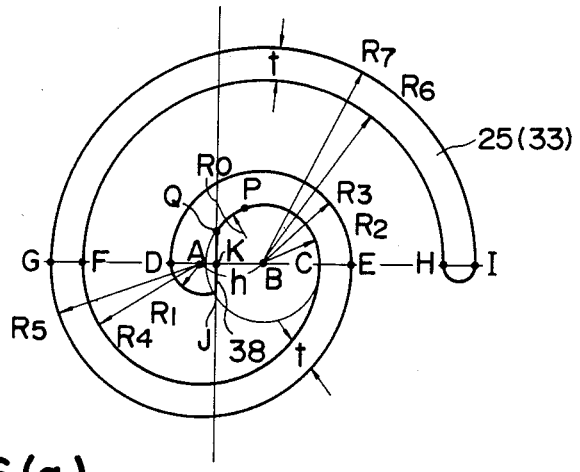
FIG. 5 is a plan view showing a scroll blade used in the present invention.

FIG. 5 shows a configuration commonly utilized for the stationary scroll blade 33 and the orbitally movable scroll blade 25 of the present invention, which is substantially equal to that of the conventional blades described hereinbefore.

More specifically, assuming that the thicknesses of the two blades 25 and 33 are equal to t, and that the radius of the revolution of the orbitally movable blade 33 is equal to e, two points A and B are determined at positions spaced apart by a distance $h=e+t$. An arc $\widehat{PC}$ and a semicircle $\widehat{DE}$ are drawn around the point B with radii equal to $R_2=t+e$ and $R_3=2t+e$, respectively. Likewise, lower semicircles $\widehat{CF}$ and $\widehat{EG}$ are drawn around the point A with radii $R_4=2t+2e$ and $R_5=3t+2e$, respectively. Then upper semicircles $\widehat{FH}$ and $\widehat{GI}$ are drawn around the point B with radii $R_6=3t+3e$ and $R_7=4t+3e$, respectively.

According to the present invention, the internal (or central) end of the scroll blade is configured as follows.

Figure 6A:
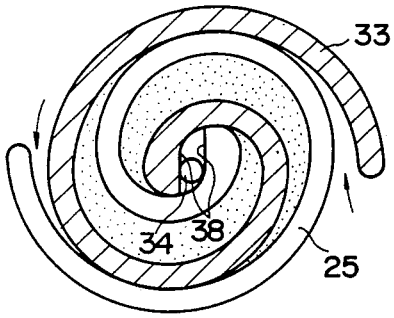
FIGS. 6(*a*), 6(*b*) and 6(*c*) are plan views showing various stages of the compressing operation of the compressor according to the present invention.
Figure 6B:
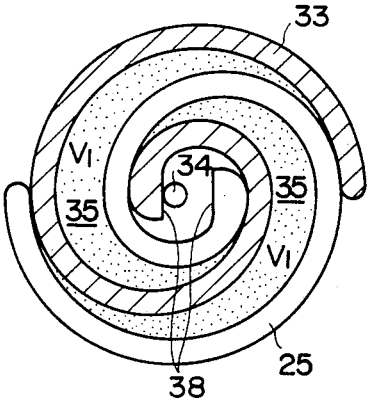
Figure 6C:
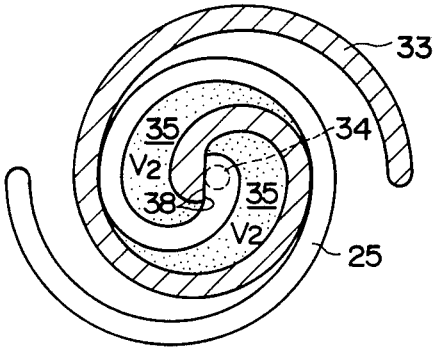

An arc is drawn around the point A with a radius $R_1=t$ (thickness of the blade). A point K is selected on the line AB so that DK=

$$\frac{3}{2}t,$$

and a line perpendicular to the line AB is drawn through the point K so that the line intersects with the arc drawn around the point A at a point J. Furthermore, an arc $\widehat{CP}$ is drawn around the point B with a radius $R_2=t+e$, and the point P and the perpendicular line are connected together with a radius of curvature $R_0=e$ which smoothly joins the perpendicular lines as shown in FIG. 6(*a*). The outer end of the scroll blade is closed by a semicircle $\widehat{HI}$.

FIGS. 6(*a*), 6(*b*) and 6(*c*) illustrate various stages of the operation of the compressor utilizing the scroll blades shown in FIG. 5. Among these drawings, FIG. 6(*a*) indicates a stage wherein a gaseous fluid is received between the stationary blade 33 and the movable blade 25, while FIG. 6(*b*) indicates a stage wherein the gas is compressed to a volume $V_1$ in each of the two spaces between the stationary blade 33 and the movable blade 25. FIG. 6(*c*) indicates the last stage of the compression wherein the volume of the gas in each space is reduced to $V_2$, whereafter the compressed gas is permitted to leave the compressor through discharge port 34, shown in phantom in FIG. 6(*c*).

Figure 7:
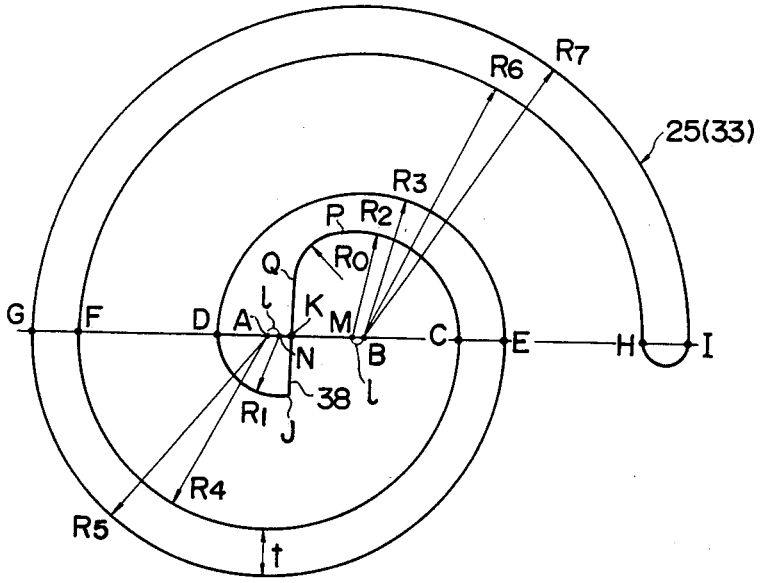
FIG. 7 is a plan view showing a scroll blade constituting another embodiment of the invention.

FIG. 7 illustrates another embodiment of the present invention wherein the stationary scroll blade 33 and the movable scroll blade 25 are both formed into a configuration as follows.

Points A and B are spaced apart by a distance $h=t+e$ as in the previous embodiment, while points M and N are positioned on the line segment $\overline{AB}$ such that $AN=BM=l$, wherein l is selected in a range of $0<l<$ $$\frac{t}{2}.$$

An arc $\widehat{PC}$ of a radius $R_2=h+l=t+e+l$ is drawn around the point M, and then a semicircle $\widehat{DE}$ of a radius $R_3=h+t=2t+e$ is drawn around the point B. Then, semicircles $\widehat{CF}$ and $\widehat{EG}$ are drawn around the point A with radii $R_4=2h=2t+2e$ and $R_5=3t+2e$, respectively. Furthermore, semicircles $\widehat{FH}$ and $\widehat{GI}$ are drawn around the point B with radii $R_6=3t+3e$ and $R_7=4t+3e$, respectively.

In addition, a point K is selected on the line segment $\overline{AB}$ so that $\overline{DK}=$ $\frac{3}{2}t$, and a line perpendicular to the line $\overline{AB}$ is drawn through the point K. An arc is drawn around the point N with a radius $R_1=t+1$ so that the arc intersects the perpendicular line at a point J. The perpendicular line passing through the point K is smoothly connected at a point Q with the arc $\widehat{PC}$ with a radius of curvature $R_0=e$. The outer end of the scroll blade is terminated with a semicircle $\widehat{HI}$.

Figure 8A:
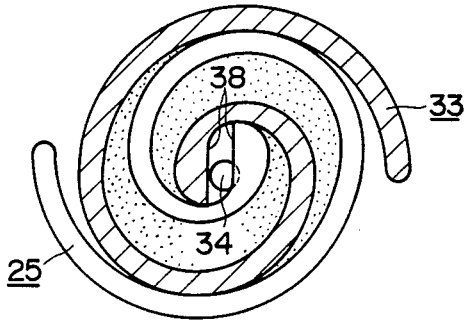
FIGS. 8(*a*), 8(*b*) and 8(*c*) are plan views showing various stages of the compressing operation of the embodiment shown in FIG. 7.
Figure 8B:
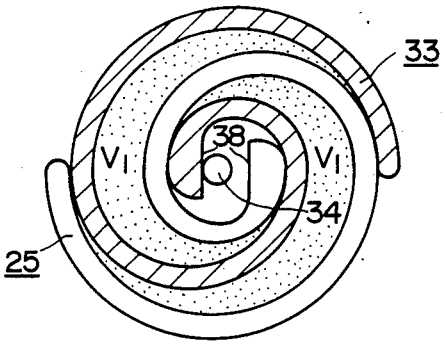
Figure 8C:
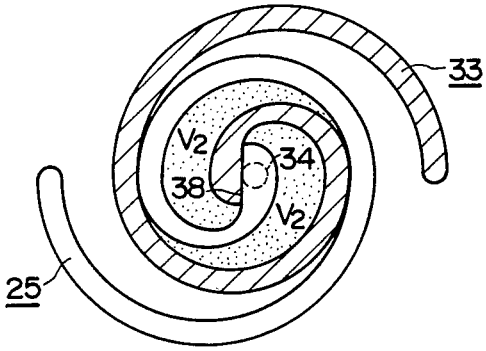

FIGS. 8(*a*), 8(*b*) and 8(*c*) illustrate compression stages of a compressor utilizing the stationary scroll blade 33 and the movable scroll blade 25 both formed in accordance with the second embodiment of the invention shown in FIG. 7. As is apparent from FIG. 8(*c*), at the last stage of the compression, the linear edge at the internal end of the blade 33 abuts against the linear edge at the internal end of the blade 25, thus eliminating the residual region tending to be created at the last stage of the conventional compressor.

Figure 9:
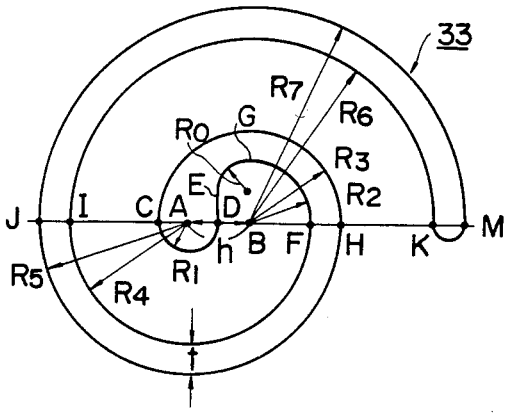
FIG. 9 is a plan view showing a stationary scroll blade constituting still another embodiment of the invention.
Figure 10:
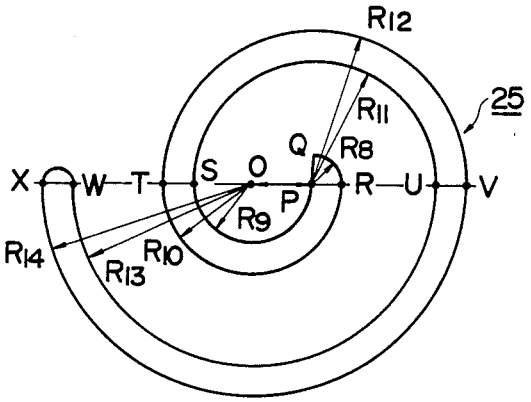
FIG. 10 is a plan view showing an orbitally movable scroll blade constituting the still another embodiment of the invention.

In still another embodiment of the present invention, the stationary scroll blade 33 is formed as shown in FIG. 9 and the movable scroll blade 25 is formed as shown in FIG. 10.

In the configuration shown in FIG. 9, points A and B are assumed as in the previous embodiment, and a semicircle $\widehat{CD}$ is drawn around the point A with a radius $R_1=t$, and a line perpendicular to the line $\overline{AB}$ is drawn through the point D. Then an arc $\widehat{GF}$ is drawn around the point B with a radius $R_2=t+e$, and the arc $\widehat{GF}$ and the perpendicular line are connected together smoothly through an arc $\widehat{EG}$ of a radius $R_0=e$. Furthermore, a semicircle $\widehat{CH}$ is drawn around the point B with a radius $R_3=2t+e$, and semicircles $\widehat{FI}$ and $\widehat{HJ}$ are drawn around the point A with radii $R_4=2t+2e$ and $R_5=3t+2e$, respectively. Then semicircles $\widehat{IK}$ and $\widehat{JM}$ are drawn around the point B with radii $R_6=3t+3e$ and $R_7=4t+3e$. The outer end of the scroll blade is closed by a semicircle $\widehat{KM}$.

Likewise, the orbitally movable scroll blade 25 is formed as follows. Points O and P are assumed to be spaced apart by a distance $h=t+e$. An arc with a radius $R_8=t$ is drawn around the point P so that the arc intersects at a point Q with a line drawn perpendicular to the line $\overline{OP}$ through the point P. Then, semicircles PS and $\widehat{RT}$ are drawn around the point O with radii $R_9=t+e$ and $R_{10}=2t+e$, respectively. Semicircles $\widehat{SU}$ and $\widehat{TV}$ are drawn around the point P with radii $R_{11}=2t+2e$ and $R_{12}=3t+2e$, respectively, and then semicircles $\widehat{UW}$ and $\widehat{VX}$ are drawn around the point O with radii $R_{13}=3t+3e$ and $R_{14}=4t+3e$, respectively. The outer end of the scroll blade 25 is closed with a semicircle $\widehat{XW}$.

Figure 11A:
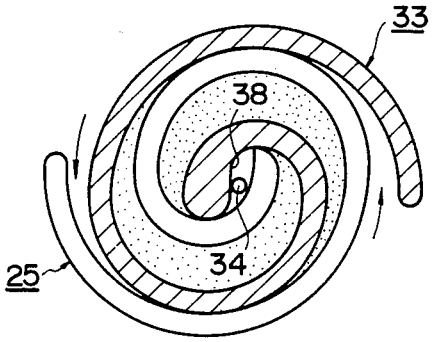
FIGS. 11(*a*), 11(*b*) and 11(*c*) are plan views showing various stages of the compressing operation of the embodiment shown in FIGS. 9 and 10.
Figure 11B:
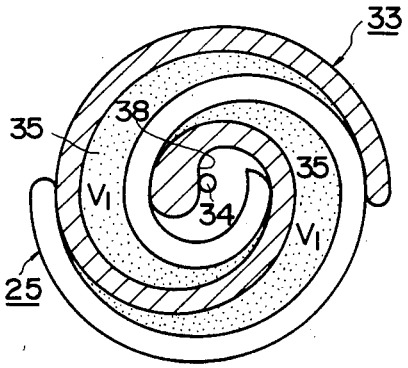
Figure 11C:
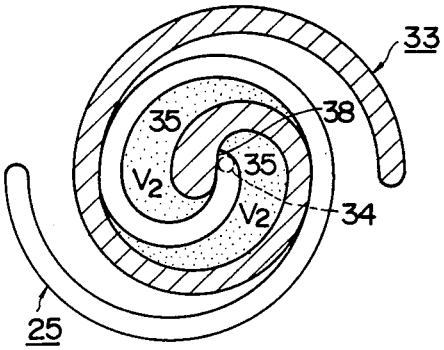

FIGS. 11(*a*), 11(*b*) and 11(*c*) illustrate compression stages of the compressor including the stationary scroll blade 33 and the orbitally movable scroll blade 25 formed in accordance with the embodiment shown in FIGS. 9 and 10. In the stage shown in FIG. 11(*a*), a gaseous fluid is received between the two scroll blades, while in the stage shown in FIG. 11(*b*), the fluid of a volume $V_1$ is confined in each of compression spaces formed between the two blades. In the last stage of the compression shown in FIG. 11(*c*), the volume of the fluid in each compression space is reduced to $V_2$.

Figure 12:
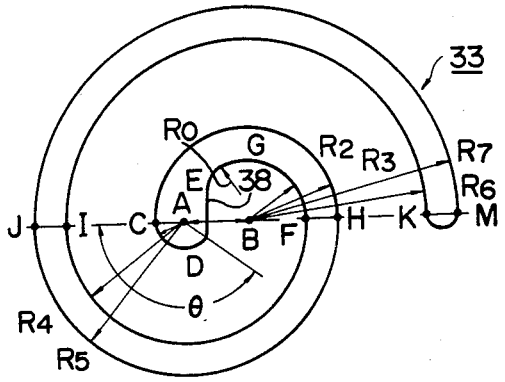
FIG. 12 is a plan view showing a stationary scroll blade constituting one part of a further embodiment of the invention.
Figure 13:
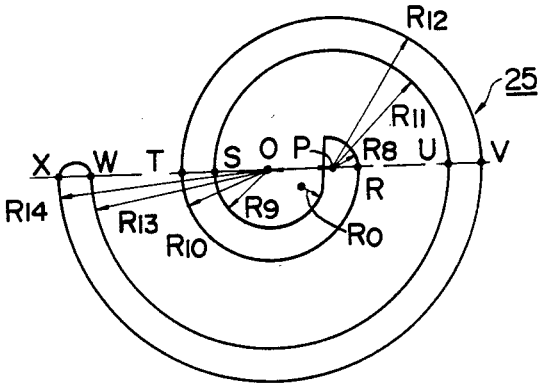
FIG. 13 is a plan view showing an orbitally movable scroll blade constituting another part of the further embodiment of the invention.

In the embodiment shown in FIGS. 9 and 10, the inner end of stationary scroll blade 33 has been formed into a semicircle $\widehat{CD}$, this may otherwise be formed such that a central angle $\theta$ subtended by the arc $\widehat{CD}$ is not 180°, but less than 180° as shown in FIG. 12. In this case, the orbitally movable scroll blade 25 shown in FIG. 10 must be slightly modified as shown in FIG. 13 so that the semicircle formed around the point O with the radius $R_9$ is reduced to an arc less than the semicircle.

Furthermore, it should be noted that the different configurations of the stationary scroll blade 33 and the orbitally movable scroll blade 25 in either of the embodiments shown in FIGS. 9 and 10, and 12 and 13 may be interchanged between the stationary blade 33 and the movable blade 25 without causing any discrepancy.

According to the present invention, linear portions are provided at the inner end of both of the stationary blade 33 and the movable blade 25 in a manner that the portions are disposed perpendicularly to the line drawn through two central points such as A, B and O, P, and the linear portions are brought into contact with each other at the end of the compression stage of the compressor. Thus, the residual portion of the compressive space formed in the conventional scroll type compressor can be substantially eliminated, and the size of the delivery port of the compressor can be increased as desired. Furthermore, since the volume of the compression spaces at the end of the compressive stage can be far reduced from that of the conventional scroll type compressor, the compression ratio of the compressor can be much improved, and the size of the compressor as well as the frictional loss thereof can be reduced remarkably.

We claim:

1. A scroll compressor comprising a casing, an electric motor and a compressor unit housed in the casing, said compressor unit comprising a movable member having a first scroll blade driven eccentrically by said electric motor, a structural member having a second scroll blade encasing said movable member so that said first scroll blade revolves around a central axis of the compressor with a predetermined radius of revolution e, while the first scroll blade is maintained in sliding contact with the second scroll blade, each scroll blade having a thickness t and being formed by drawing a series of semicircles alternately around a first point and a second point spaced apart from the first point by a distance equal to a distance corresponding to the sum of said predetermined radius e and thicknesses t, and by connecting these semicircles together, and an internal end portion including a planar surface extending perpendicular to a line interconnecting said first and second points on at least one of both sides thereof, one end of said planar surface being connected with an arc formed around said first point and the other end of said planar surface being connected with an arc having a radius of curvature R equal to the predetermined radius of revolution e, said arc in turn being connected to an internal semicircle drawn around a point on said line interconnecting said first and second points.

2. A scroll compressor as set forth in claim 1 wherein said planar surface formed at said internal end portion of each scroll blade is so arranged that a maximum thickness of the scroll blade at said portion having the planar surface is made equal to $\frac{3}{2}t$.

3. A scroll compressor as set forth in claim 1 wherein an end of said planar surface is connected with an arc formed around the first point with a radius equal to the thickness t.

4. A scroll compressor as set forth in claim 1 wherein an outer end surface of the internal end portion adjacent to the planar surface is formed by an arc drawn around a point N offset inwardly by $l(0<l<t)$ from the first point with a radius equal to $t+l$.

5. A scroll compressor as set forth in claim 1 wherein the internal end portion of either one of said two scroll blades is formed by a semicircle drawn around the first point with a radius equal to the thickness t, an internal end of said semicircle being connected with said perpendicular line which in turn is connected with an arc drawn around the second point with a radius $(t+e)$ through an arc having a radius of curvature; while the internal end portion of another one of said two scroll blades is formed by a planar portion which is connected with a semicircle drawn around the first point with a radius $(e+t)$, and a quadrant drawn around the second point with a radius equal to the thicknes t.

6. A scroll compressor as set forth in claim 1 wherein the internal end portion of either one of said two scroll blades is formed by an arc subtending a central angle of less than 180°, which is drawn around the first point with a radius equal to the thickness t, an internal end of said arc being connected with said perpendicular line which in turn is connected with an arc drawn around the second point with a radius $(t+e)$ through a radius of curvature; while the internal end portion of another one of said two scroll blades is formed by a planar portion connected with an arc subtending a central angle of less than 180°, which is drawn around the first point with a radius $(e+t)$, and an arc drawn around the second point with a radius equal to the thickness t.

7. A scroll compressor as set forth in claim 1 wherein said other end of said planar surface is connected tangentially to said arc having a radius of curvature R.

* * * * *